US005219311A

United States Patent [19]

Fildan

[11] Patent Number: 5,219,311

[45] Date of Patent: Jun. 15, 1993

[54] BRASSIERE WIRE OR STAY

[76] Inventor: Gerhard Fildan, Kriehubergasse 31, A-1050 Vienna, Austria

[21] Appl. No.: 937,964

[22] Filed: Aug. 28, 1992

[51] Int. Cl.[5] ..... A41C 1/12; A41C 1/14

[52] U.S. Cl. ..... 450/41; 450/47; 450/52; 2/260.1

[58] Field of Search ..... 2/67, 73, 259, 260, 2/261, 262, 263, 264, 260.1; 450/41, 42, 43, 44, 45, 46, 47, 48, 49, 50, 51, 52

[56] References Cited

U.S. PATENT DOCUMENTS

| | | | |
|---|---|---|---|
| 2,762,055 | 9/1956 | Bermueuer | 450/51 |
| 3,605,753 | 9/1971 | Schwartz | 450/52 |
| 3,702,614 | 11/1972 | Miller | 450/52 |
| 3,777,763 | 12/1973 | Schwartz | 450/52 |
| 4,203,449 | 5/1980 | Winzelberg | 450/49 |
| 4,770,650 | 9/1988 | Rowell | 450/41 X |

*Primary Examiner*—Clifford D. Crowder
*Assistant Examiner*—Jeanette E. Chapman
*Attorney, Agent, or Firm*—Herbert Dubno

[57] ABSTRACT

A brassiere wire has a body adapted to fit into a channel in a brassiere to extend beneath a breast cup of a brassiere, the brassiere wire having a semicircular body lying in a plane and of flattened cross section, and a rectilinear flexible portion on at least one end of the body, the rectilinear portion being deflectable resiliently out of the plane, the rectilinear portion having two spaced-apart grooves corresponding across the rectilinear portion substantially perpendicular thereto and in each face of such rectilinear portion, thereby reducing the thickness of the wire at the grooves of the rectilinear portion to increase flexibility thereof, the wire being composed of a plastic and having rounded tips.

14 Claims, 3 Drawing Sheets

BRASSIERE WIRE OR STAY

FIELD OF THE INVENTION

My present invention relates to a brassiere wire and stay for so-called underwire brassieres, i.e. a wire adapted to be inserted into a channel in a fabric brassiere below the breast, adapted to lie against the sternum and the lateral pectoral region and composed of a synthetic resin or plastic material so as to provide stability and flexibility to the brassiere in these regions.

BACKGROUND OF THE INVENTION

So-called brassiere wires are well known and comprise a wire which may be independent or part of a frame and which has an arcuate shape, while being received in a correspondingly shaped channel stitched into the fabric of the brassiere to extend along the underside of each brassiere cup, to lie generally against the sternum and lateral pectoral region and to provide support for the breast.

Such brassiere wires are provided in a variety of shapes and configurations and must satisfy a number of requirements. For example, the brassiere wire must not pose danger to the wearer by poking through the fabric to cause injury or to damage clothing of the wearer. It also must be readily insertable.

The wire should tolerate washing and be compatible with the wearer, should not present excessive stiffness, but yet be capable of providing support without permanent distortion or shape change which may result in distortion of the shape of the brassiere.

In U.S. Pat. No. 4,306,565, for example, a brassiere wire is disclosed which has encapsulated tips with locking pins extending through apertures in the plastic tip to retain the latter on the wire. In U.S. Pat. No. 4,175,740, a brassiere frame is provided in which two brassiere wires are joined together at sleeve-shaped members at the center of the frame and tips similar to those previously described are provided on the free ends of the wire.

Another underbust flat wire for use below a brassiere cup is described in U.S. Pat. No. 4,133,316 and likewise has tips at the ends thereof. Stitching through brassiere frame members is described in U.S. Pat. No. 3,702,614.

To avoid the drawbacks of a metallic wire which might poke through the brassiere, U.S. Pat. No. 3,114,374 describes a brassiere stay in which the wire is completely encased in plastic tubing with the ends of the tubing crimped over the ends of the wire.

A breast-enhancement brassiere is described in U.S. Pat. No. 5,098,330 and likewise has a wire extending within a channel along and following the curvature of the cup of a brassiere. The cups of a camisole garment can likewise be provided with a wire (U.S. Pat. No. 5,045,018) and, as noted, a metallic spring wire has been used to form a stiffening member for a brassiere (U.S. Pat. No. 4,770,650), a portion of this member being annealed to soften it.

A method of making a brassiere Wire whereby a sheath of flexible material is formed around a wire member and an end thereof is broken off within the sheath is described in U.S. Pat. No. 4,285,113.

U.S. Pat. No. 4,245,644 discloses a brassiere with support providing kinetic energy transfer and U.S. Pat. No. 4,201,220 discloses another brassiere wire having sheathed tips. A tubular wire form inserted into a knit article for a seamless brassiere is the subject of U.S. Pat. No. 3,772,899 whereas the brassiere described in U.S. Pat. No. 3,726,286 encloses underbust wire stays which are secured to lower edge portions and inner and outer layers of the breast cups. Still earlier designs using undercup stays, wires or frames are found in U.S. Pat. Nos. 3,717,154; 3,701,614; 3,599,643; and 3,394,706. (See also U.S. Pat. Nos. 3,252,460; 3,126,007 and 2,109,431.)

Notwithstanding the considerable efforts expended in developing brassiere wires or stays heretofore, it has been found that problems remain with respect to the comfort of a brassiere equipped with a wire or stay, especially when that wire or stay extends above the midway point across the cup. In such cases, comfort problems do arise where the wire or stay is excessively stiff.

OBJECTS OF THE INVENTION

It is, therefore, the principal object of the present invention to provide an improved brassiere wire or stay whereby drawbacks of earlier such stays are avoided.

Another object of the invention is to provide an improved set of brassiere wires designed for use in brassieres of a number of sizes, which all have an improved comfort factor by comparison with earlier stays or wires.

Still another object of the invention is to provide a brassiere wire or stay which is particularly comfortable to wear, can be inserted and retained in the brassiere particularly conveniently and without endangering the user or garments of the user, and which is inexpensive to manufacture.

SUMMARY OF THE INVENTION

These objects and others which will become apparent hereinafter are attained, in accordance with the present invention, in a brassiere wire or stay which has a curved portion extending from a free end of the wire to a flexible zone at which the wire becomes rectangular and extends substantially beyond a semicircle, the wire being of flat cross section and rounded at its tips while being composed of a plastic or synthetic resin of a composition hitherto used for the fabrication of brassiere wires, such as a polyolefin like polypropylene or polyethylene, a polyamide such as a nylon or a polyester.

According to the invention, the flexible rectilinear portion has enhanced flexibility for deflection out of the plane of the wire by reason of a pair of spaced-apart thin regions, i.e. regions of reduced thickness perpendicular to this plane and dimensioned so that the deflection of the zone out of the plane causes the bend of the wire in this region to have a circular arc segmental shape of generally constant radius.

According to the invention, therefore, a flexure or flexible zone extends rectilinearly at least on one side of the semicircular arc of the brassiere wire although the flexible zone can be provided at both ends of the wire if desired. The thin regions of the flexible zones preferably extend perpendicularly to the longitudinal edges of the rectilinear portion and the innermost zone can have a greater thickness than the outermost zone. The wire can taper in thickness along its length, although it is preferred to provide the region between the thin zones so that its thickness is less than that of the body of the wire while the terminal region of the flexible zone between its tip and the outermost thin region is itself thinner than the intermediate region.

According to another feature of the invention, the wire forms one of a set of wires differing by the radial width as to the radius of the semicircular portion. Between the longitudinal edges of the wire, a neutral middle line can be provided which, for brassieres of sizes ranging from 30B through 52B including intermediate sizes with cups A-C, for example, can range between 167 mm to 338 mm in length. Typical neutral middle line lengths for this size range can be 167, 183, 198, 214, 229, 245, 260, 276, 291, 307, 322 and 338 mm.

The thickness of the body of the wire may range between 1.5 and 2.5 mm and is preferably between 1.8 and 2.2 mm. The radial width of the body of the wire may be between 3.4 and 4.1 mm and preferably is about 4 mm.

The wire can have, in a preferred embodiment, a body thickness of 2.0 mm, an inner thin region with a thickness of 1.40 mm an intermediate thickness region of 1.50 mm, an outer thin region with a thickness of about 1.0 mm and an outermost region of a thickness of about 1.35 mm.

The cross section of the wire at the body, the thin regions or grooves and the intermediate and outer regions is preferably rectangular with rounded corners.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
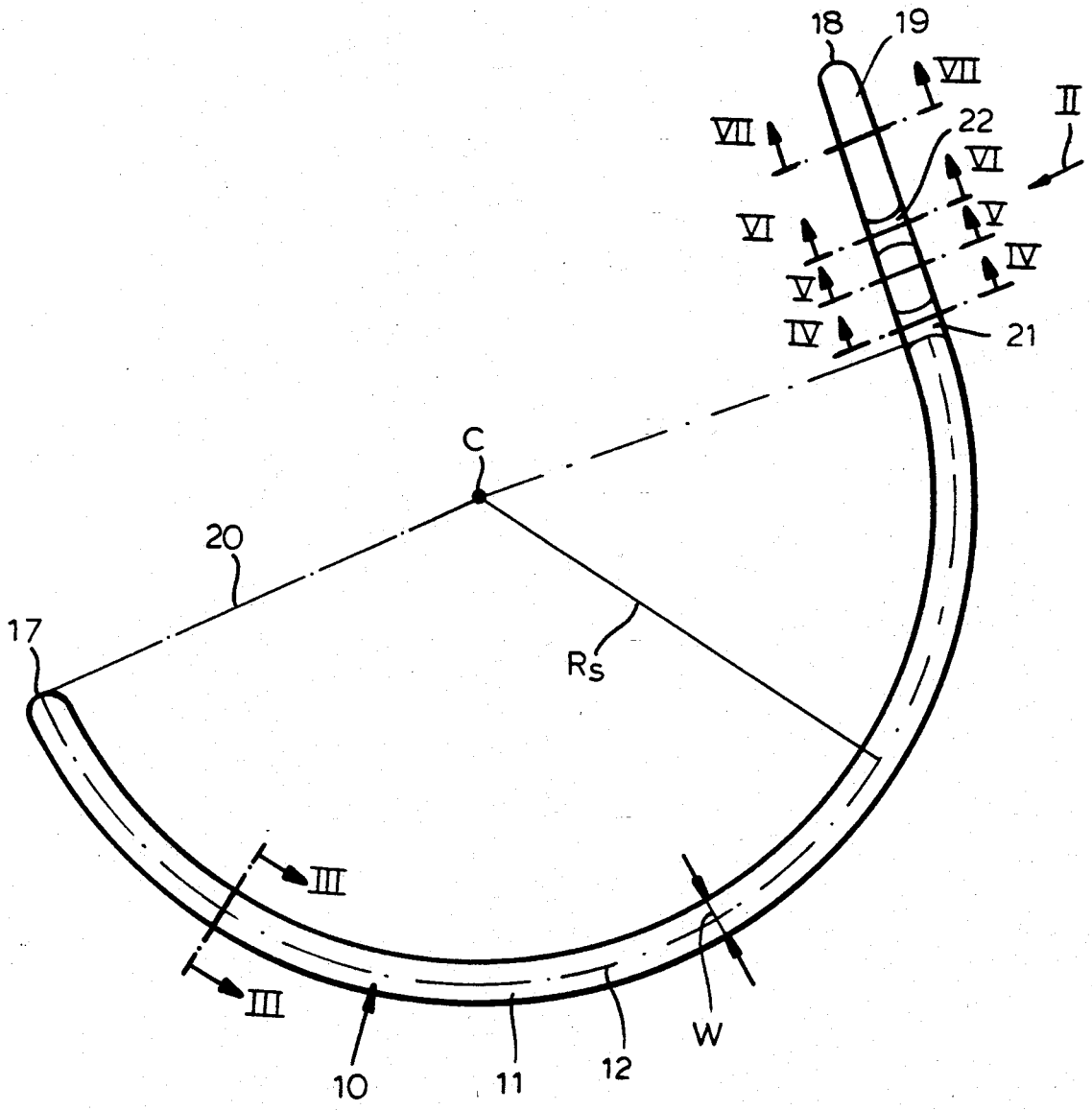
FIG. 1 is an elevational view of a plastic brassiere wire or stay, according to the invention.

In FIG. 1 of the drawing, I have shown a brassiere wire 10 which has a semicircular portion 11 with a radius of curvature $R_S$ running to a neutral middle line 12 midway between the longitudinal edges 13 and 14 of this portion of the brassiere wire.

Figure 3:
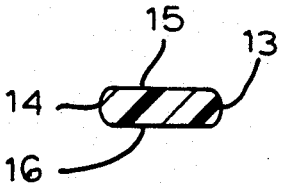
FIG. 3—7 are cross sectional views taken along lines III—III, IV—IV, V—V, VI—VI, and VII—VII of FIG. 1, respectively.

The body 11 is of flattened cross section (see FIG. 3) with planar surfaces 15 and 16 parallel to the plane of the paper of FIG. 1 and parallel to the plane of the wire. The wire is composed of one of the plastics previously described and is inserted in a channel of a brassiere below a breast cup thereof and extends upwardly from the region below the breast cup where the wire lies against the sternum to the lateral pectoral region. The tips of the wire are rounded at 17 and 18.

Figure 4:
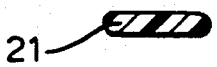
Figure 5:
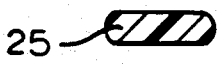
Figure 6:
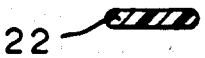
Figure 7:
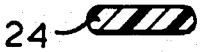

As can be seen from FIG. 1, the wire has a flexible rectilinear zone 19 which extends beyond the diameter 20 which runs through the center C and the tip 17 and which is formed unitarily with the body 11 by injection molding therewith and has two spaced-apart grooves 21 and 22 respectively and cross sections shown in FIG. 4 and 6, providing flexibility to this rectilinear portion or flexible zone.

Figure 2:
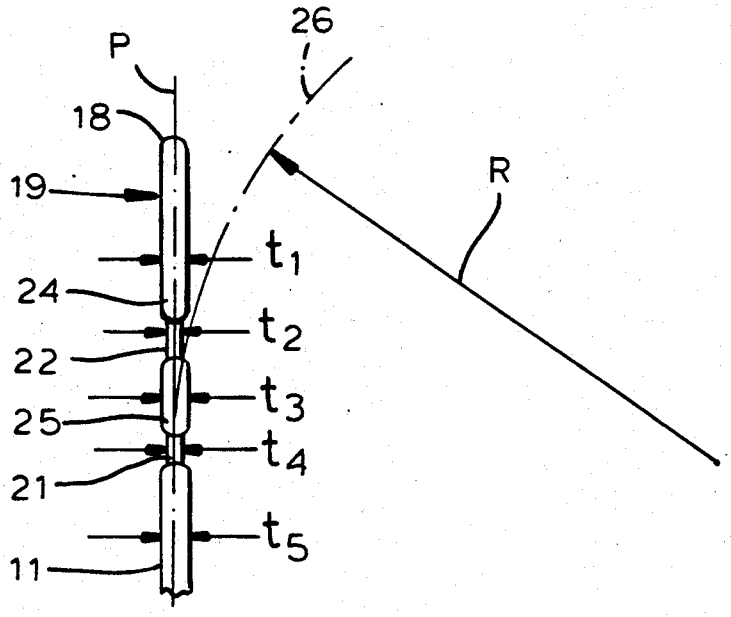
FIG. 2 is a view of the flexible zone or rectilinear portion of this wire as seen in the direction of the arrow II of FIG. 1.

As can be seen from FIG. 2, the body of the wire can have a thickness $t_5$ which is greater than the thickness of the intermediate region 25 between zones 21 and 22 and the end zone 24 provided with the tip 18. The thicknesses of the regions 24, 22, 25, 21 and 11 are thus represented at $t_1$ to $t_5$ respectively. The thickness $t_2$ is less than $t_4$, so that the flexible zone 19 will deflect along a circular pattern represented at 26 out of the plane P of the brassiere wire with a radius of curvature R.

The width of the wire remains constant over its entire length and is represented at W, although, if desired, this width can taper toward the ends. A flexible rectilinear zone can be provided as well on the opposite end of the wire.

Figure 8:
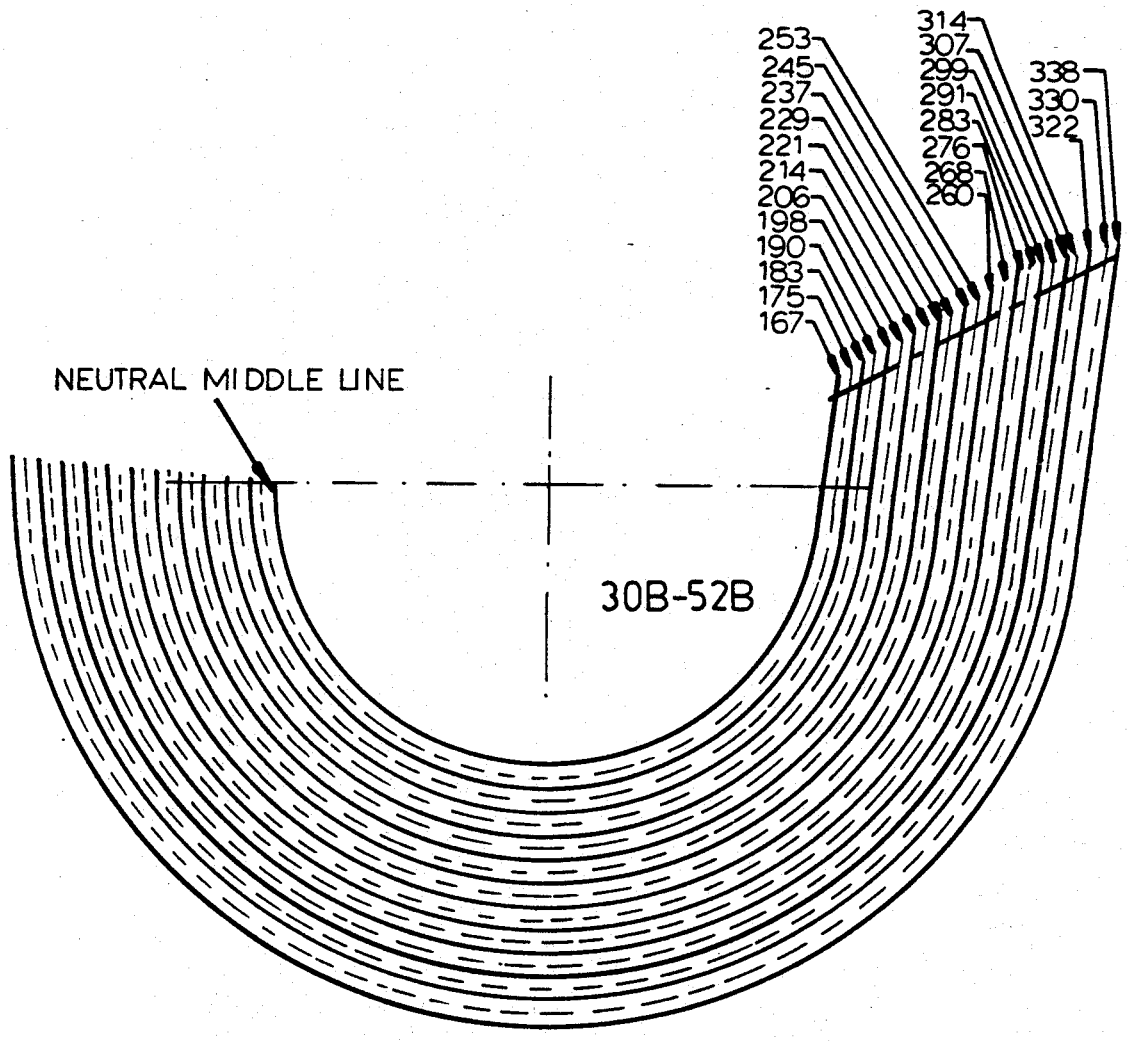
FIG. 8 shows a set of wires.

As can be seen from FIG. 8, a set of such wires can be provided with identical widths W of say, 4 mm and identical cross sections, but different diameters or radii of the semicircular portion and different neutral middle line lengths for a range of brassiere sizes. Preferred cross sections of the semicircular body are $4.1 \times 2.2$ and $3.5 \times 1.8$, the cross sections being rectangular (FIGS. 3-7) with rounded corners. From the set shown in FIG. 8, a specific wire can be selected to suit the cup size.

In a particularly preferred embodiment, for a width W of about 4 mm, a radius R of about 72 mm, the body can have a thickness of 2.0 mm, the inner groove can leave a thickness $t_4$ of 1.4 mm, $t_3$ can be 1.5 mm, $t_2$ can be 1.0 mm and $t_1$ can be 1.35 mm.

With brassiere wires of this construction, a high flexibility is provided without permanent deformation out of the plane of the wire as is particularly important at the sternum and pectoral regions while within the plane, the wire has adequate support stability. Piercing through the fabric does not occur and the wires have been found to be particularly comfortable.

I claim:

1. A brassiere wire receivable in a channel in a brassiere to extend beneath a breast cup of a brassiere, said brassiere wire comprising a semicircular body lying in a plane and of flattened cross section being composed of plastic and having rounded tips at opposite ends thereof, and a rectilinear flexible portion on at least one of said ends of said body, said rectilinear portion being deflectable resiliently out of said plane, said rectilinear portion having two spaced-apart grooves corresponding across said rectilinear portion substantially perpendicular thereto and in each face of such rectilinear portion, the thickness of the wire at said grooves of said rectilinear portion being less than the thickness of the remainder of said body to increase flexibility of said rectilinear portion, said wire being of substantially constant width in said plane over an entire length of said wire including said body and said rectilinear portion, said grooves including an outer groove closer to a tip of said rectilinear portion and an inner groove spaded from said outer groove away from said tip of the rectilinear portion, said wire having a lesser thickness at said outer groove than at said inner groove, whereby deflection of said rectilinear portion out of said plane imparts a continuous curvature to said rectilinear portion.

2. The brassiere wire defined in claim 1 wherein said continuous curvature is curvature substantially along a circular arc.

3. The brassiere wire defined in claim 2 wherein said outer groove defines an outer portion of said rectilinear portion with the tip thereof and an intermediate portion with said inner groove, said outer portion having a lesser thickness than said intermediate portion and said intermediate portion having a lesser thickness than said body.

4. The brassiere wire defined in claim 3 wherein said wire has a width measured in said plane of substantially 3.25 to 4.25 mm.

5. The brassiere wire defined in claim 4 wherein said width is 3.85 to 4.1 mm.

6. The brassiere wire defined in claim 4 wherein said body has a thickness of substantially 1.8 to 2.2 mm.

7. The brassiere wire defined in claim 6 wherein said body has a neutral middle line between longitudinal edges thereof of a length selected from 167 mm to 338 mm.

8. A set of brassiere wires for brassieres of different sizes, each of said wires comprising:

a respective semicircular body lying in a plane and of flattened cross section and formed with a rounded body tip and having a respective radius and a respective pair of spaced apart longitudinal edges; and a respective rectilinear flexible portion on at least one end of said body opposite said body tip and formed with a respective rounded portion tip said rectilinear portion being formed with a respective rounded portion tip spaced from the body tip, each of the wires being centered on a longitudinal median line spaced equidistantly from the respective pair of longitudinal edges and defining a respective total length of the wire, said edges defining a respective substantially constant width in the plane over the respective length therebetween, said rectilinear portion being deflectable resiliently out of said plane said rectilinear portion having:

an outer groove formed closer to the portion tip, and an inner groove spaced from the outer groove further from the portion or corresponding across said rectilinear portion substantially perpendicular thereto and in each face of said rectilinear portion, the thickness of the wire at being less at said grooves of said rectilinear portion than elsewhere over said body to increase flexibility of said resilient portion, said wire having a lesser thickness at said outer groove than at said inner groove and being composed of a plastic, the rectilinear portion being of continuous curvature upon deflecting of the rectilinear portion out of the plane, the radius of the respective body and the total length of the body along the median line of each wire differing from the radius and length of other wires of the set, all wires of the set having essentially a common center of the respective body and said middle lines having lengths selected from the group which consists of 167, 183, 198, 214, 229, 245, 260, 276, 291, 307, 322 and 338 mm.

9. The brassiere wire set defined in claim 8 wherein each of said wires is of continuous curvature and said curvature is substantially along a circular arc.

10. The brassiere wire set defined in claim 9 wherein each of said wires has an outer groove defining an outer portion of said rectilinear portion with the tip thereof and an intermediate portion with said inner groove, said outer portion having a lesser thickness than said intermediate portion and said intermediate portion having a lesser thickness than said body.

11. The brassiere wire set defined in claim 10 wherein each of said wires has a width measured in said plane of substantially 3.25 to 4.25 mm.

12. The brassiere wire set defined in claim 11 wherein said Width is 3.85 to 4.1 mm.

13. The brassiere wire set defined in claim 11 wherein each of said wires has a body thickness of substantially 1.8 to 2.2 mm.

14. The brassiere wire set defined in claim 13 wherein said body has a neutral middle line between longitudinal edges thereof of a length selected from 167 mm to 338 mm.

* * * * *